US010076753B2

(12) United States Patent
Yi

(10) Patent No.: US 10,076,753 B2
(45) Date of Patent: Sep. 18, 2018

(54) DISPOSABLE CONTAINER AND MIXING SYSTEM COMPRISING THE CONTAINER

(71) Applicant: GE HEALTHCARE BIO-SCIENCES CORP., Piscataway, NJ (US)

(72) Inventor: Shujian Yi, Nashua, NH (US)

(73) Assignee: GE HEALTHCARE BIO-SCIENCES CORP., Piscataway, NJ (US)

( * ) Notice: Subject to any disclaimer, the term of this patent is extended or adjusted under 35 U.S.C. 154(b) by 0 days.

(21) Appl. No.: 13/916,261

(22) Filed: Jun. 12, 2013

(65) Prior Publication Data

US 2014/0367394 A1 Dec. 18, 2014

(51) Int. Cl.

| | |
|---|---|
| ***B65D 1/42*** | (2006.01) |
| ***B01L 3/00*** | (2006.01) |
| *B01F 13/08* | (2006.01) |
| *B01F 15/00* | (2006.01) |

(52) U.S. Cl.

CPC ..... *B01L 3/505* (2013.01); *B01F 13/0872* (2013.01); *B01F 15/0085* (2013.01); *B01F 15/00668* (2013.01); *B01L 2200/087* (2013.01); *B01L 2300/0832* (2013.01); *B01L 2300/0851* (2013.01); *B01L 2300/123* (2013.01)

(58) Field of Classification Search

CPC ..... B65D 15/22; B65D 37/00; D06F 95/004; B01L 3/505

USPC ..... 220/651, 652, 653, 654, 9.1, 9.2, 9.3, 220/495.06; 248/95, 97; 366/197, 198, 366/204

See application file for complete search history.

(56) References Cited

U.S. PATENT DOCUMENTS

| | | | | |
|---|---|---|---|---|
| 858,488 | A * | 7/1907 | Tynes | B65D 37/00 220/9.2 |
| 3,207,103 | A * | 9/1965 | Hillman | F23G 5/42 110/241 |
| 4,596,779 | A | 6/1986 | Ono | |

(Continued)

FOREIGN PATENT DOCUMENTS

| | | |
|---|---|---|
| CN | 1261320 A | 7/2000 |
| CN | 2401480 Y | 10/2000 |

(Continued)

OTHER PUBLICATIONS

EP Search Report dated Dec. 21, 2016 from EP Application No. 259340-4.

(Continued)

*Primary Examiner* — Andrew T Kirsch
*Assistant Examiner* — Don M Anderson
(74) *Attorney, Agent, or Firm* — Grogan, Tuccillo & Vanderleeden, LLP

(57) ABSTRACT

The present invention relates to a disposable container (100) comprising a side wall (2, 32), top (4) and bottom (6), wherein the side wall (2; 32) and the bottom (6) comprise a flexible material, wherein the side wall (2; 32), top (4) and bottom (6) are joined together to define the container (100) with an interior compartment (10) for keeping a fluid inside the container (100). The bottom (6) of the container (100) comprises at least one portion of rigid or semi-rigid material comprising a folding means (124; 224; 324; 324') that enables folding of the bottom (6). Thus an easy way of folding the bottom of the container is provided.

11 Claims, 5 Drawing Sheets

(56) References Cited

U.S. PATENT DOCUMENTS

| | | | | |
|---|---|---|---|---|
| 4,837,875 | A * | 6/1989 | Shamie | A47D 13/063 5/99.1 |
| 5,881,975 | A * | 3/1999 | Bianco | B65B 67/1227 248/95 |
| 5,897,211 | A * | 4/1999 | Hafer et al. | 383/119 |
| 6,334,593 | B2 * | 1/2002 | Inoue | 248/95 |
| 6,461,043 | B1 * | 10/2002 | Healy et al. | 383/204 |
| 7,025,318 | B2 * | 4/2006 | Hurst et al. | 248/331 |
| 8,960,486 | B2 * | 2/2015 | Goodwin | B01F 7/00691 220/661 |
| 2001/0048054 | A1 | 12/2001 | Inoue | |
| 2006/0280028 | A1 * | 12/2006 | West et al. | 366/331 |
| 2008/0237239 | A1 * | 10/2008 | Pham et al. | 220/495.06 |
| 2011/0091139 | A1 | 4/2011 | Ahmed | |
| 2011/0310696 | A1 * | 12/2011 | Goodwin | B01F 7/00691 366/204 |

FOREIGN PATENT DOCUMENTS

| | | | |
|---|---|---|---|
| CN | 1274385 | A | 11/2000 |
| CN | 2635552 | Y | 8/2004 |
| CN | 1531589 | A | 9/2004 |
| CN | 101001945 | A | 7/2007 |
| CN | 101119896 | A | 2/2008 |
| CN | 101119897 | A | 2/2008 |
| CN | 101163538 | A | 4/2008 |
| CN | 101300338 | A | 11/2008 |
| CN | 102575219 | A | 7/2012 |
| CN | 102648044 | A | 8/2012 |
| JP | H11222244 | A | 8/1999 |
| JP | H11217102 | A | 9/1999 |
| JP | 2008501347 | A | 1/2008 |
| JP | 3146510U | U | 11/2008 |
| TW | 200904714 | A | 2/2009 |
| WO | 2005068059 | A1 | 7/2005 |

OTHER PUBLICATIONS

Search Report dated Dec. 2, 2016 from EP Application No. 201480033709.X.

* cited by examiner

DISPOSABLE CONTAINER AND MIXING SYSTEM COMPRISING THE CONTAINER

FIELD OF THE INVENTION

The present invention relates to a technical field of disposable containers and mixing systems comprising disposable containers.

BACKGROUND OF THE INVENTION

Single-use or disposable systems are rapidly increasing in different industries and especially in industries that require use of clean rooms, such as in biopharmaceutical industry. Disposable systems are flexible and cost-effective and for example cleaning processes may be reduced. Disposable components in disposable systems are sterilized and it is assured that they are qualified to regulatory requirements. Disposable systems are easy to adapt to different production purposes and it is easy and less costly than traditionally to change a product line while good process reliability may be maintained or even improved.

There are several kinds of disposable systems, such as mixing systems, in which disposable containers or bags are used. These containers or bags comprise often sheets of flexible material, such as plastic, plastic laminates or corresponding materials.

One type of mixing system in which such containers can be used is a bioreactor system in which cells or microorganisms can grow. Mixing systems include also systems used to prepare for example buffer and media.

Mixing systems may comprise a support or vessel which supports or houses a disposable bag or container of the above-mentioned type. The support may be a support plate or tray for a bioreactor bag of a kind used in GE Healthcare WAVE Bioreactor®. The vessel may be a tank-type support which has a substantially cylindrical form, for example substantially circular cylindrical and comprises rigid material such as stainless steel to provide sufficient support for the flexible bag or container, for example of a kind used in Xcellerex XDR™ Single-use bioreactors. The flexible container or bag is placed inside the vessel in an accurate manner so that for example different pipelines or tubes, mixers and sensors can be connected to the bag properly and accurately. WO 2005/118771 A2 discloses a disposable system of this kind.

Containers may vary in size from about 1-2000 liters, but even larger containers may be used, such as up to 5000 liters. To stabilize or reinforce the containers or to enable the connection of different pipelines or sensors to the containers they often comprise portions of rigid or semi-rigid materials. These rigid or semi-rigid portions provide a platform for safe and secure attachment of for example sensors, pipelines for fluids (both gas and liquid) and mixers. Further, the rigid or semi-rigid parts can reinforce and stabilize the containers and therefore facilitate placing of the containers into mixing vessels in accurate manner. However, these rigid parts also make the containers bulky which may make it difficult to store and transport the containers. Thus, there is a need to reduce the size of the containers during transport and storage.

SUMMARY OF THE INVENTION

The object of the present invention is to provide a container and a mixing system comprising the container which has a reducible size during storage and transport.

The objects above are obtained by a disposable container according to the present invention comprising a side wall, top and bottom, wherein the side wall and the bottom comprise a flexible material, wherein the side wall, top and bottom are joined together to define the container with an interior compartment for keeping a fluid inside the container. The bottom comprises at least a portion of rigid or semi-rigid material comprising a folding means that enables folding of the bottom Thus, a disposable container that is easy to fold to reduce the size of the container is provided.

The portion of rigid or semi-rigid material is preferably a rod and the bottom of the container may comprise at least two rods of rigid or semi-rigid material comprising the folding means. In this way the bottom structure is reinforced.

The rods may be arranged to be in contact with each other. This further reinforces the bottom structure. The rods may be arranged perpendicular to each other and they may form a cross-shaped structure, whereby the stability of the bottom can be improved.

The foldable portion of rigid or semi-rigid material may be arranged to be in contact with a support structure of rigid or semi-rigid material that is adapted to support a mixing device placed in the interior compartment of the container. In this way support may be provided to a mixer in a simple way while the bottom is foldable.

The folding means may be foldable only in one direction. In this way, the handling and the stability of the container can be improved, and for example unintentional folding of the bottom during installation is prevented.

The folding means may be at least one hinge. Thus a simple mechanism for the folding means can be provided.

The flexible material in the container can be a plastic laminate. Thus strong and sterilizable material may be obtained.

The side wall, top and bottom (6) may be joined together by means of a heat seal and/or an adhesive seal. Thus, sterilizable and hermetically sealed container may be obtained.

The invention further relates to a mixing system comprising a vessel for housing the disposable container as described above.

Further features and advantages of the present invention are explained in connection with the detailed description and appended drawings.

DETAILED DESCRIPTION OF THE INVENTION

Figure 1:
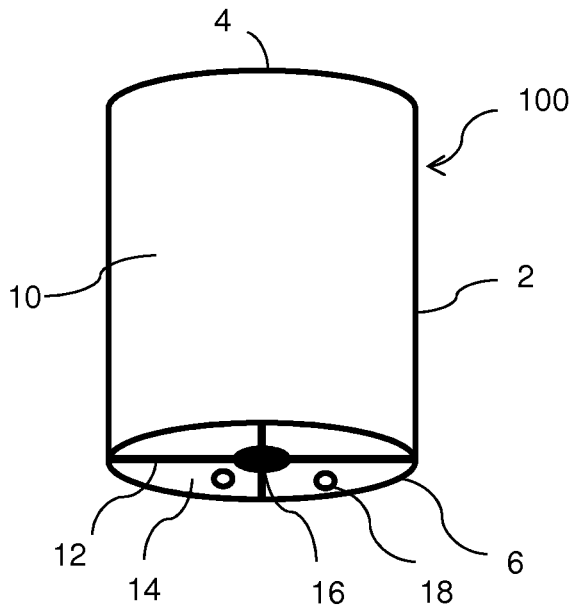
FIG. 1 schematically shows a perspective view of a disposable container according to one embodiment of the invention.

In FIGS. 1-8 examples of bottom constructions for containers according to the present invention are shown. The skilled person realizes however that for example the container 1 shown in FIG. 1 may have another form or be of another type as long as the container comprises a side wall, top and bottom, wherein the side wall comprises a first flexible material and the bottom comprises a rigid or semi-rigid material and wherein the side wall, top and bottom are joined together to define the container with an interior compartment for keeping a fluid inside the container. The fluid can be liquid and/or gas. The container may have a volume of from about 10 to 5000 liters, such as from 10 to 2000 liters.

What is meant by flexible material used in the present invention is a material that can be easily bent without breaking. The flexible material may have a thickness of less than 1 mm, suitably of from about 0.005 mm to about 0.7 mm, and preferably of from about 0.01-0.5 mm depending on the size and form of the container or bag. The flexible material may have a flexural modulus according to ASTM D790 of less than 2000 MPa. The flexibility of the material is further defined by the thickness of the material, i.e. basically that the thinner the material the more flexible the material. However, two materials of equal thickness may have different flexibility due to the differences in flexural modulus of the materials.

The flexible material may be a polymeric film material and can be made of a mono layer material or a laminate comprising two or more layers, e.g. polymeric material films. The flexible material comprises at least one layer of a polymeric film material having thermoplastic properties. The polymeric film material should be sterilizable and preferably resists gamma radiation, i.e. it substantially retains its properties after gamma radiation. Suitable materials may be conventional film materials used in packaging industry and preferably for example mono layer or multi-layer PE (polyethylene), ULDPE (Ultra Low Density Polyethylene), LLDPE (Linear Low density Polyethylene), EVOH (Ethylene Vinyl Alcohol) and PA (polyamide). The material may also be a laminate film comprising one or more polymeric materials or the material may be for example multi-layer coextruded polyethylene film, such as ULDPE/EVOH/PE/PA. The laminate film may be further comprised of two or more material layers of different thermoplastic materials which have different melting points. However, the mentioned flexible materials are only examples of suitable materials and any flexible material with thermoplastic properties which fulfills product requirements can be used.

By rigid or semi-rigid material is meant a material which is unbending or may be slightly bent, i.e. it has slightly flexible and/or elastic properties. The flexural modulus of the rigid material is preferably greater than 200 MPa according to ASTM D790. The flexural modulus value may be overlapping with the flexural modulus value of the flexible material, but the rigidity of the material is further defined by the thickness of the material. The rigid material can have a thickness of from about 1 mm. There is no upper limit for the thickness of the rigid material. The rigid or semi rigid material is further substantially dimensionally stable and is preferably moldable and can be a polymeric material. Examples of suitable materials are for example low density polyethylene or high density polyethylene materials, polyamide or polypropylene. Further, the rigid or semi rigid material may be a composite material comprising a polymer matrix, such as polyester, vinyl ester, polyamide polypropylene or any other mouldable polymer material. The polymer material preferably has thermoplastic properties and can be sterilized and preferably resists gamma radiation, i.e. it substantially retains its properties after gamma radiation. The rigid parts can be for example vacuum formed or moulded for example by injection moulding.

By rod is meant a slim substantially cylinder-shaped shaft construction, which may be hollow or solid and is made of rigid or semi-rigid material.

The seal between the flexible and the rigid or semi-rigid material, e.g. between the top, bottom and/or rods in the bottom, side wall of the present invention, can be obtained by several means. The seal should be fluid-tight so that sterile conditions inside the container can be maintained. The seal can be obtained by means of an adhesive, by heat-sealing or by using both heat-sealing and adhesive.

The adhesives used in the adhesive seal are preferably medical grade adhesives. The adhesives can be for example hot-melt adhesives, UV-curable adhesives or solvent-based adhesives. The hot-melt adhesives used should preferably have a lower melting point than the flexible film material so that the flexible film does not melt when the hot-melt adhesive is applied to the material. Examples of adhesives are for example epoxy- or silicone-based adhesives, such as MasterBond X17 and 3M DP8005. Further, for example adhesive tape could be used.

The heat seal is obtained by bringing the flexible material in contact with heat, so that the thermoplastic component in the material melts and provides the heat seal. The heat seal may be obtained by any suitable manner, which are per se known to the skilled person, for example by hot air welding or conventional heat mold sealing.

The present invention is further illustrated in the figures as described below.

FIG. 1 shows a disposable container 100 comprising a side wall 2 comprising a flexible material, e.g. a plastic film, and a bottom 6 comprising a flexible material and rods of rigid or a semi-rigid material. The bottom 6 of the container 100 stabilizes and reinforces the container 100. The bottom 6 comprises rods 12 of rigid or semi-rigid material that support the bottom 6 and a support structure 16 for a mixing device, such as an impeller means (not shown). The impeller means may be for example driven by magnetically coupled drive means. The bottom 6 may also comprise port connectors 18 to connect pipes, sensors, etc. to the container. The connectors 18 are positioned in portions 14 comprising flexible material.

Generally, the rods may have e.g. a circular or a square cross section. The diameter or the height of the rod may vary depending of the size of the container, but may be for example from about 5 mm to about 100 mm.

The container 100 further comprises a top 4, which may be made of a flexible or rigid or semi-rigid material, or of a combination of flexible and rigid or semi-rigid material.

The side wall 2, the top 4 and the bottom 6 are joined together for example by means of a seal which can be obtained by means of an adhesive, by heat-sealing or by using both heat-sealing and adhesive as described above, to define the container 100. A fluid inside the container is kept in the interior compartment 10 of the container 100 in a sterile manner.

Figure 2:
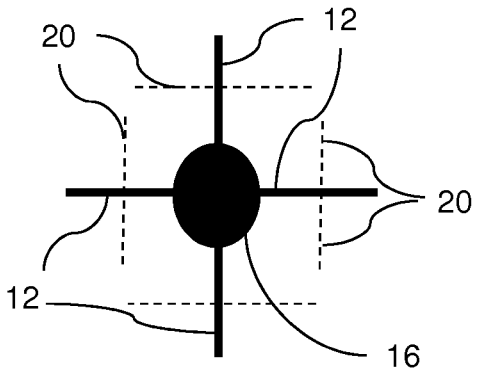
FIG. 2 schematically shows a view of the bottom structure comprising rods of rigid or semi-rigid material.

In FIG. 2 the construction of the bottom rods is shown schematically in more detail than in FIG. 1. The rods 12 are arranged perpendicular to each other and the rods 12 form a cross-shaped structure. The support structure 16 is arranged in the crossing point of the rods 12. The support structure 16 may be connected to the rods 12 on top of the rods. The rods can be connected to each other underneath the support structure 16 by suitable means as is described more in detail below. The support structure 16 could also form a middle section of the cross-shaped structure, and the rods 12 could be attached to the periphery of the support structure 16. The dotted folding lines 20 show a folding line for the bottom 6. Folding means is thus arranged in each rod 12 at the crossing point of the folding line 20 and the rod 12. Examples of the folding means and function thereof are shown in FIGS. 3-8.

Figure 3:
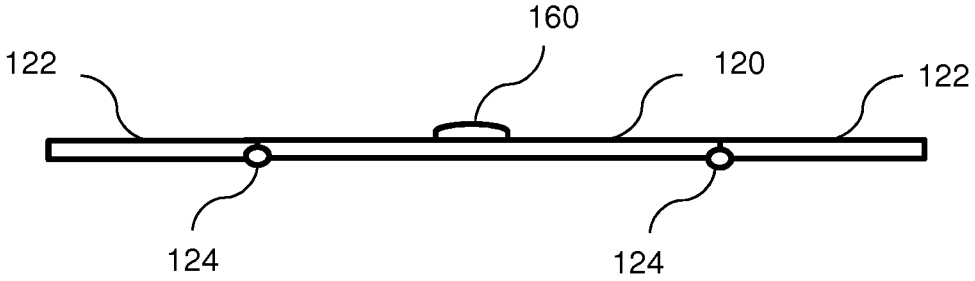
FIG. 3 schematically shows a side view of an example construction comprising a rod, folding means and support structure in unfolded position.

In FIG. 3 an example of a rod 120 comprising a folding means 124 is shown. The rod comprises two end parts 122 and a support structure 160 is attached on the top of the rod 120 by suitable means, e.g. by heat-sealing or by using adhesive or by mechanical means. In this FIG. 3, only one rod 120 having end parts 122 is shown, but the structure could comprise more than one rod.

Generally, if more than one rod is used, each of the rods may be connected to the support structure 16 by suitable means, e.g. by adhesion, heat-sealing or by mechanical connection. A mechanical connection could be attained for example by the support structure comprising recesses having a diameter or height that corresponds to the diameter of the rod to enable the placement of the rods underneath the support structure and in relation to each other in suitable manner. E.g. a pair of recesses, i.e. two recesses having a height corresponding to twice the diameter or the height of the rod, may be placed opposite to each other in the periphery of the support structure 16. In this way one rod can be positioned in proximity of a lower surface of the support structure. Another pair of recesses in which the height of the recesses corresponds to the diameter or the height of another rod, may then be positioned opposite to each other in the periphery of the support structure so that the rods can be positioned perpendicular to each other. The other rod is then placed in these recesses so that the two rods form a cross-shaped structure.

Alternatively, the rods may be glued or heat-sealed together so that they are in contact with each other. The support structure may then be attached to the rod or rods by means of gluing, heat-sealing or mechanical means in a corresponding manner as described above.

Figure 4:
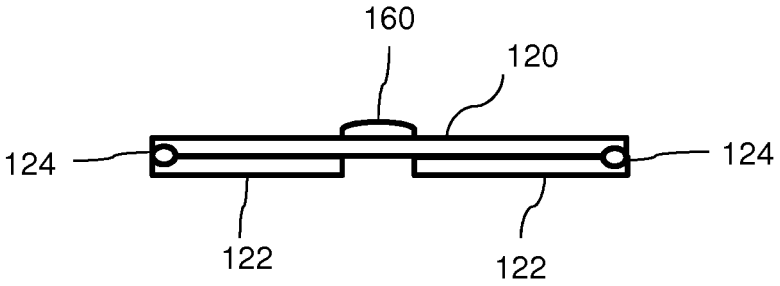
FIG. 4 schematically shows a side view of the structure in FIG. 3 in folded position.

The folding means 124 that may be a hinge of a joint, enables folding of the end parts 122 of the rod 120 in one direction to ensure the stability of the bottom 6. As shown in FIG. 4, the end parts 122 of the rod 120 can be folded downwards and underneath the rod 120. The side wall (not shown) is attached to the peripheral end of the end parts 122. When the end parts 122 are folded, the side wall follows the end parts 122 underneath the rod 120 due to the flexibility of the side wall material. In this way, the size of the bottom may be decreased during transport and storage. When the container is to be used, the end parts 122 are unfolded by pulling the end parts out upwards.

Generally, the folding means may be a joint or a hinge that enables folding. Preferably, the folding is enabled in one direction only. Foldable joints or hinges of any kind may be used. By hinge is meant a device that holds together two parts of the rod such that one can swing the parts relative to the other. By joint is meant a junction between rod parts, which may be for example elastic to allow folding of the rod parts. Preferably, the material for the joint or hinge is also rigid or semi-rigid plastic material as described above.

Figure 5:
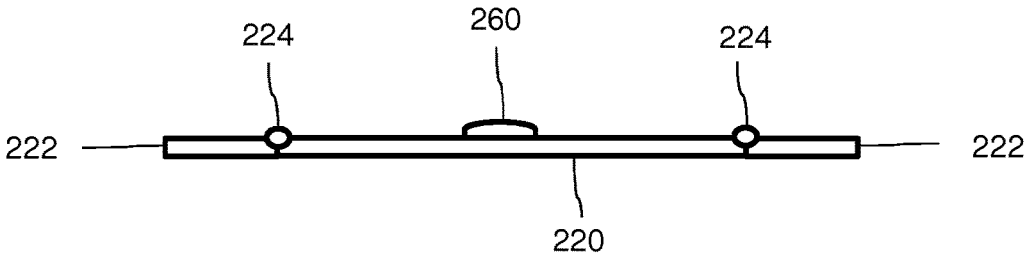
FIG. 5 schematically shows a side view of another example construction comprising a rod, folding means and support structure in unfolded position.
Figure 6:
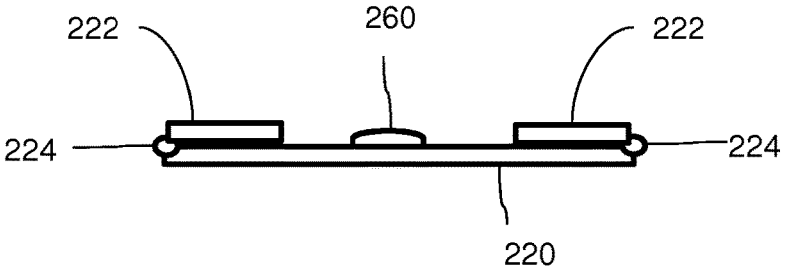
FIG. 6 schematically shows a side view of the structure in FIG. 5 in folded position.

In FIGS. 5 and 6 another example of a rod 220 comprising a folding means 224 is shown. The rod comprises two end parts 222 and a support structure 260 is attached on the top of the rod 220 by suitable means as described above. In this FIG. 5, the structure is similar to the structure shown in FIG. 3, except that the end parts 222 are folded upwards above the rod 220, and thus also the side wall attached to the periphery of the end parts 222 is folded above the rod 120. In this way, the size of the bottom may be decreased during transport and storage. Also the end parts 222 may protect the support structure 260 e.g. against pressure from the outside during transport and storage, since the total height of the rod 220 and the end parts 222 may be higher than the height of the support structure 260, whereby a partial encapsulation of the support structure 260 is obtained. The folding means 224 may be a joint or a hinge of the type described above.

Figure 7:
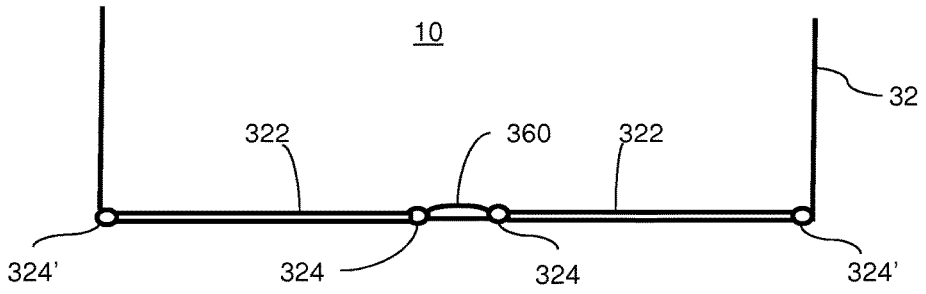
FIG. 7 schematically shows a side view of another example construction comprising a rod, folding means and support structure in unfolded position.
Figure 8:
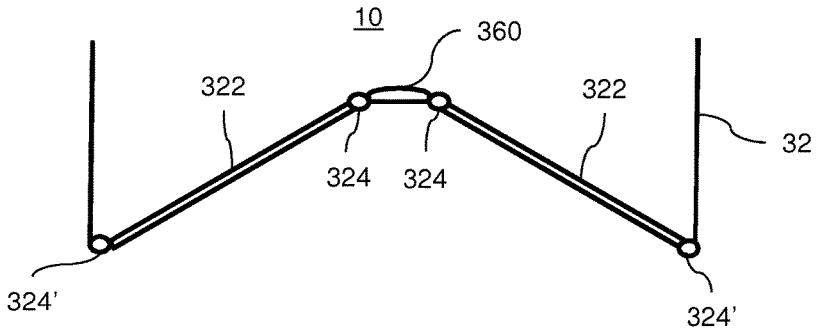
FIG. 8 schematically shows a side view of the structure in FIG. 7 in folded position.
Figure 9:
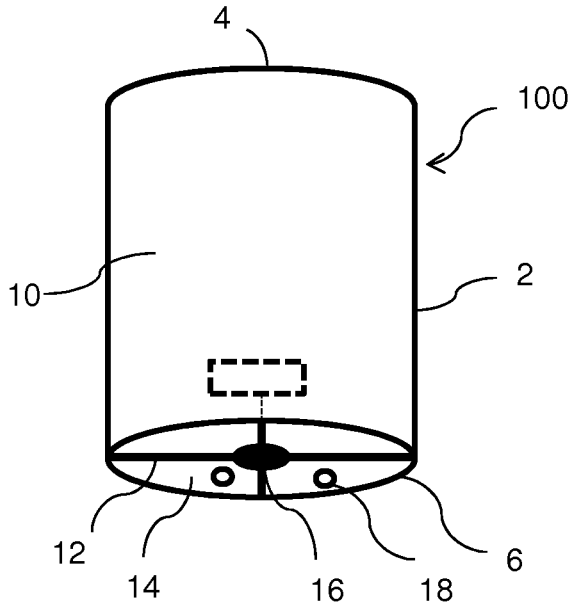
FIG. 9 schematically shows a modification of FIG. 1 with a mixing device included.
Figure 10:
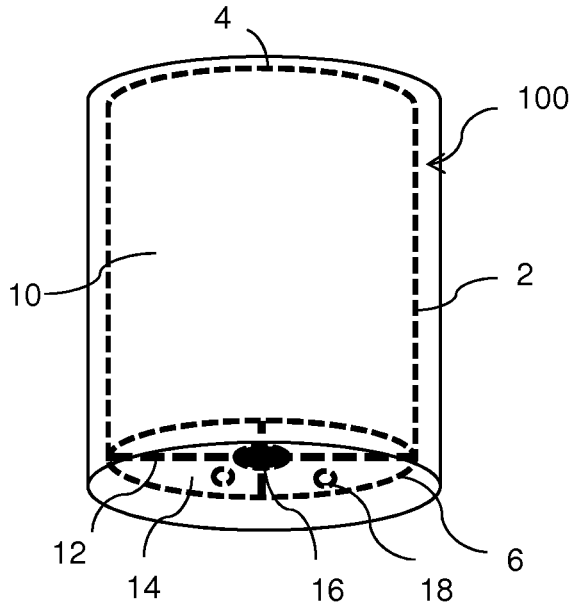
FIG. 10 schematically shows a modification of FIG. 1 with a housing vessel included.

A further example of a rod structure enabling folding of the bottom 6 according to the present invention is shown in FIGS. 7 and 8. In this example, the structure comprises two rods 322 connected via a hinge 324 to a support structure 360. However, more than two rods may be used, such as for example 4-8 rods. The ends of the rods 322 are attached to a side wall 32 surrounding the interior compartment 10 of the container via additional hinges 324'. These additional hinges 324' are optional and could be also left out, since the side wall 32 is flexible.

As illustrated in FIG. 8, when folding of the container is desired, the support structure 360 is pushed inwards towards the interior compartment 10 of the container. Thus, the hinges 324 allow the movement inwards and the bottom of the container can be folded. When it is desirable to use the container, the bottom is unfolded by pulling the support structure 360 outwards.

Generally, the top of the container may be flexible or comprises rigid or semi-rigid material. The top of the container may also be foldable in a similar manner as described above. The folding of the top may be done in the same manner as the bottom, or different rod structures could be used for the top and bottom, respectively.

The container 100 with the foldable bottom described above can be used in a mixing system comprising an outer vessel that houses the disposable container of the present invention. In the container 100 different kinds of fluids can be fermented or cultivated, and/or prepared. The container 100 may comprise ports 18 to connect for e.g. a sparger to deliver gas into the container, or for example different sensors or any other pipe needed to deliver or drain materials in or out of the container. Example of a mixing system in which the container according to the present invention is usable is shown for example in WO 2005/118771 A2.

The examples above should not be considered limiting the invention in any way. Instead, the scope of the invention is limited by the appended claims.

What is claimed is:

1. A disposable container (100) for use in a bioreactor mixing system having an outer vessel for receiving the disposable container therein, the disposable container comprising:

a side wall (2, 32) comprising a flexible material defining a side wall surface;

a top (4) comprising a flexible, rigid, or semi-rigid material defining a top surface;

a bottom (6) opposite the top (4) and comprising a flexible material defining a bottom surface that extends over the entire cross-section of the container; and a folding means associated with the bottom surface; and wherein the sidewall surface is joined to the top surface by a first seal extending along the entire periphery of the top surface, and wherein the sidewall surface is joined to the bottom surface by a second seal extending along the entire periphery of the bottom surface to define the container (100) with an interior compartment (10) for keeping a fluid inside the container (100) in a sterile manner;

wherein the folding means includes at least two rods of rigid or semi-rigid material forming a cross-shaped structure which enables the bottom (6) to be in a folded configuration or an unfolded configuration, wherein in the unfolded configuration, the at least two rods provide support for the bottom (6);

wherein the disposable container further includes a support structure of rigid or semi-rigid material for supporting a mixing device placed in the interior compartment, wherein the support structure is connected to at least one of the rods at a crossing point of the at least two rods;

wherein the support structure is connected to the at least two rods on top of the at least two rods at a crossing point of the at least two rods; and at least one of the rods is foldable upon itself such that a total height of the at least one rod, when folded upon itself, is greater than a height of the support structure.

2. The disposable container of claim 1, wherein the rods (12; 120; 220; 322) are arranged perpendicular to each other.

3. The disposable container of claim 1, wherein the folding means (124; 224; 324; 324') is foldable only in one direction.

4. The disposable container of claim 3, wherein the folding means (124; 224; 324; 324') is at least one hinge.

5. The disposable container of claim 1, wherein the flexible material is a plastic laminate.

6. The disposable container of claim 1, wherein the side wall (2), top (4) and bottom (6) are joined together by means of a heat seal and/or an adhesive seal.

7. A mixing system comprising a vessel housing the disposable container (100) of claim 1.

8. The disposable container of claim 1, wherein the bottom (6) comprises port connectors (18).

9. The disposable container of claim 1, which is adapted to hold a fluid in the interior compartment (10) in a sterile manner.

10. The disposable container of claim 1, wherein:

the rods are each connected to the support structure via a hinge.

11. The disposable container of claim 1, wherein:

the support structure is elliptical in shape.

* * * * *